United States Patent [19]

Linguanotto

[11] Patent Number: 4,685,730

[45] Date of Patent: Aug. 11, 1987

[54] SEAT, ESPECIALLY WORK SEAT, WITH SEVERAL POSITIONS

[75] Inventor: Louis Linguanotto, La Garenne, France

[73] Assignee: Etablissements Linguanotto, Courbevoie, France

[21] Appl. No.: 811,264

[22] Filed: Dec. 20, 1985

[30] Foreign Application Priority Data

Dec. 21, 1984 [FR] France ..... 84 19724

[51] Int. Cl.[4] ..... A47C 1/032

[52] U.S. Cl. ..... 297/316; 297/61; 297/320; 297/340

[58] Field of Search ..... 297/61, 312, 316, 320, 297/321, 340

[56] References Cited

U.S. PATENT DOCUMENTS

| | | | |
|---|---|---|---|
| 944,065 | 12/1909 | Wilmot | 297/320 |
| 3,102,753 | 9/1963 | Schliephacke | 297/61 |
| 3,712,666 | 1/1973 | Stoll | 297/61 |
| 4,143,910 | 3/1979 | Geffers et al. | 297/320 X |
| 4,502,729 | 3/1985 | Locher | 297/320 X |

FOREIGN PATENT DOCUMENTS

| | | | |
|---|---|---|---|
| 0017253 | 10/1980 | European Pat. Off. . | |
| 0049310 | 4/1982 | European Pat. Off. . | |
| 2541333 | 3/1977 | Fed. Rep. of Germany . | |
| 7721954 | 10/1977 | Fed. Rep. of Germany . | |
| 2843058 | 4/1980 | Fed. Rep. of Germany | 297/316 |
| 3139448 | 4/1983 | Fed. Rep. of Germany | 297/316 |
| 2069294 | 8/1971 | France . | |
| 2072977 | 8/1971 | France . | |
| 2397807 | 1/1982 | France . | |
| 2509160 | 1/1983 | France | 297/340 |
| 2001241 | 1/1979 | United Kingdom . | |

*Primary Examiner*—Kenneth J. Dorner
*Assistant Examiner*—Peter R. Brown
*Attorney, Agent, or Firm*—Beveridge, DeGrandi & Weilacher

[57] ABSTRACT

The structure (1) supporting the body on the seat is subdivided into a front seating part (2) articulated on the frame (5), a back (4) articulated on a bracket (10) which is itself articulated on the frame, and a rear seating part (3) articulated between the back (4) and the front seating part (3). A non-rigid connection (14) is provided between the rear seating part (3) and the bracket (10).

9 Claims, 3 Drawing Figures

SEAT, ESPECIALLY WORK SEAT, WITH SEVERAL POSITIONS

The present invention relates to a seat, especially a work seat, with several positions, comprising a frame mounted, preferably so as to be vertically adjustable, on a foot and bearing a body-supporting structure composed of at least two parts comprising a seating and a back connected to one another in an articulated manner, the seating being articulated directly on the frame and the back being articulated on a supporting bracket which is itself articulated on the frame, in such a way that the positions of the seating and of the back can be changed jointly, means being provided to maintain the bracket in the various positions.

Known seats of this type require means of complicated structure to provide for changes in the joint positions of the parts of the body-supporting structure, and in them this body-supporting structure does not hold the parts of the body as effectively as possible in all the positions.

The subject of the present invention is a seat of the type defined above, which, whilst having a very simple structure, provides for the parts of the body to be held as effectively as possible in all the positions which the seat can adopt.

In the seat according to the invention, the seating is divided into a front seating part articulated on the frame, and a rear seating part articulated between the front seating part and the back. The bracket is articulated on the frame in front of the joint between the rear part and the front part of the seating. The seating part is connected to the supporting bracket by means of a nonrigid connection.

As a result of this arrangement, the body-supporting structure, composed of three parts connected to one another in an articulated manner, is suspended at two points on the frame through the front seating part and on the bracket through the back, so that the three parts provide the best possible support for the body in all the positions of the seat.

The joint between the front part and the rear part of the seating preferably incorporates a stop which limits the upward travel of the said two parts about this joint.

According to another advantageous characteristic of the invention, the frame incorporates a preferably adjustable stop which limits the downward and rearward travel of the front seating part about the hinge pin of this part on the frame.

The non-rigid connection between the rear seating part and the supporting bracket of the back can advantageously consist of an elastic component, such as a spring.

Preferably, the seat according to the invention is equipped with a position-maintaining and return device which is activated when the body-supporting structure shifts from a forward position to a drawn-back position, and which automatically returns the body-supporting structure to the forward position. This device, which can comprise in parallel a pneumatic jack which can be locked in position and a preferably adjustable mechanical spring, acts on the bracket, preferably not directly, but via a two-armed lever articulated on the frame.

The seat according to the invention can also be equipped with a headrest articulated on the upper end of the back, this headrest being controlled in terms of its position jointly with the body-supporting structure, so as to pivot forwards when the body-supporting structure shifts from a forward position to a drawn-back position, and vice versa. Preferably, the headrest is controlled by a flexible cable connected, advantageously in an adjustable manner, to the two-armed lever through which the position-maintaining and return device acts on the back-supporting bracket.

With reference to the attached drawings, a non-limiting, illustrative embodiment of the subject of the invention will be described below in more detail; in the drawings.

Figure 1:
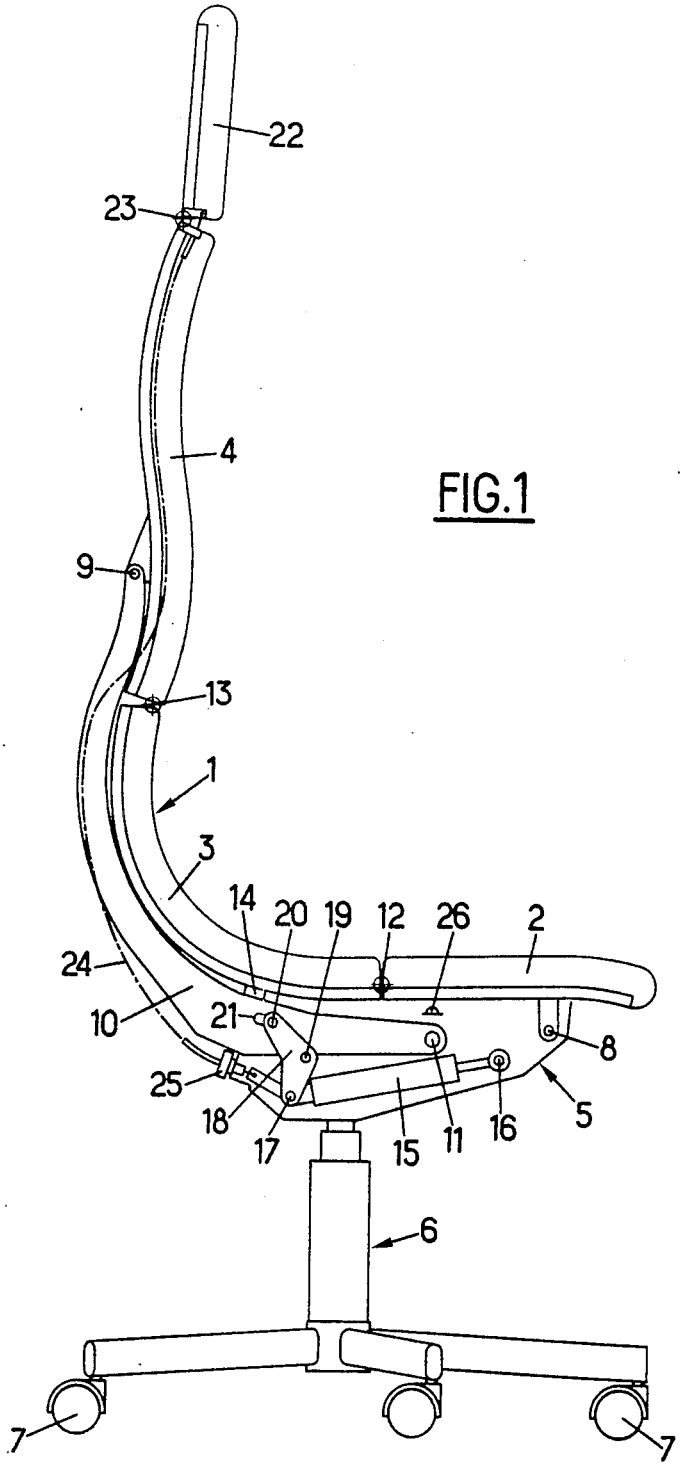
FIG. 1 is a diagrammatic view in side elevation of a seat according to the invention in the forward position (work position)

According to FIG. 1, an adjustable seat, for example a work seat, comprises a body-supporting structure 1 composed of a front seating part 2, a rear seating part 3 and a back 4. The body-supporting structure 1 is mounted on a frame 5 which is itself supported, preferably so as to be vertically adjustable, on a foot 6 which can, for example, be provided with casters 7.

The front seating part 2 is articulated, in the vicinity of its front end, on the front end of the frame 5 through a horizontal crosspin 8.

The back 4 is articulated, at a short distance above its lower end, by means of a horizontal crosspin 9 on one end of a bracket 10 substantially in the form of a rounded elbow at 90°, the other end of which bracket is articulated on the frame 5 through a horizontal crosspin 11 in front of the connection between this frame 5 and the foot 6.

The rear seating part 3 is articulated at its front end on the rear end of the front seating part 2 through a horizontal crosspin 12, and at its upper end on the lower end of the back 4 through a horizontal crosspin 13. The hinge pin 12 is arranged behind the hinge pin 11 of the bracket 10 on the frame 5. The rear seating part 3 is, over practically its entire length, curved substantially in the form of an elbow at 90° and is connected substantially tangentially to the front seating part 2 and to the back 4.

A non-rigid connecting component 14, preferably an elastic component, such as a mechanical spring or the like (for example a shock mount), connects the rear seating component 3 flexibly to the bracket 10 between the two hinge pins 12 and 13.

A position-maintaining and return device 15, preferably comprising a pneumatic jack which can be locked in position and, in parallel with this jack, a mechanical spring of preferably adjustable tension, is provided between the frame 5 and the bracket 10. The device 15 is articulated at one end on the frame 5 a through horizontal crosspin 16, in the vicinity of the front end of the frame 5, and at its other end through a horizontal crosspin 17 on one end of a two-armed lever 18 which is articulated on the frame 5 through a horizontal crosspin 19 and the other end of which lever is articulated through a horizontal crosspin 20 on the bracket 10, preferably in a slot 21 in the latter.

The seat illustrated in FIG. 1 also possesses a headrest 22 articulated on the upper end of the back 4 through a horizontal crosspin 23. The headrest 22 is controlled in terms of its position by a sheathed flexible cable 24, the cable 24 being connected to the pin 17 of the lever 18 actuated by the device 15. The sheath (not shown) of the cable 24 bears on the frame 5 via an adjustment device 25 which makes it possible to adjust the length of the sheath between these two bearing points and thus adjust the tension of the cable 24.

Figure 2:
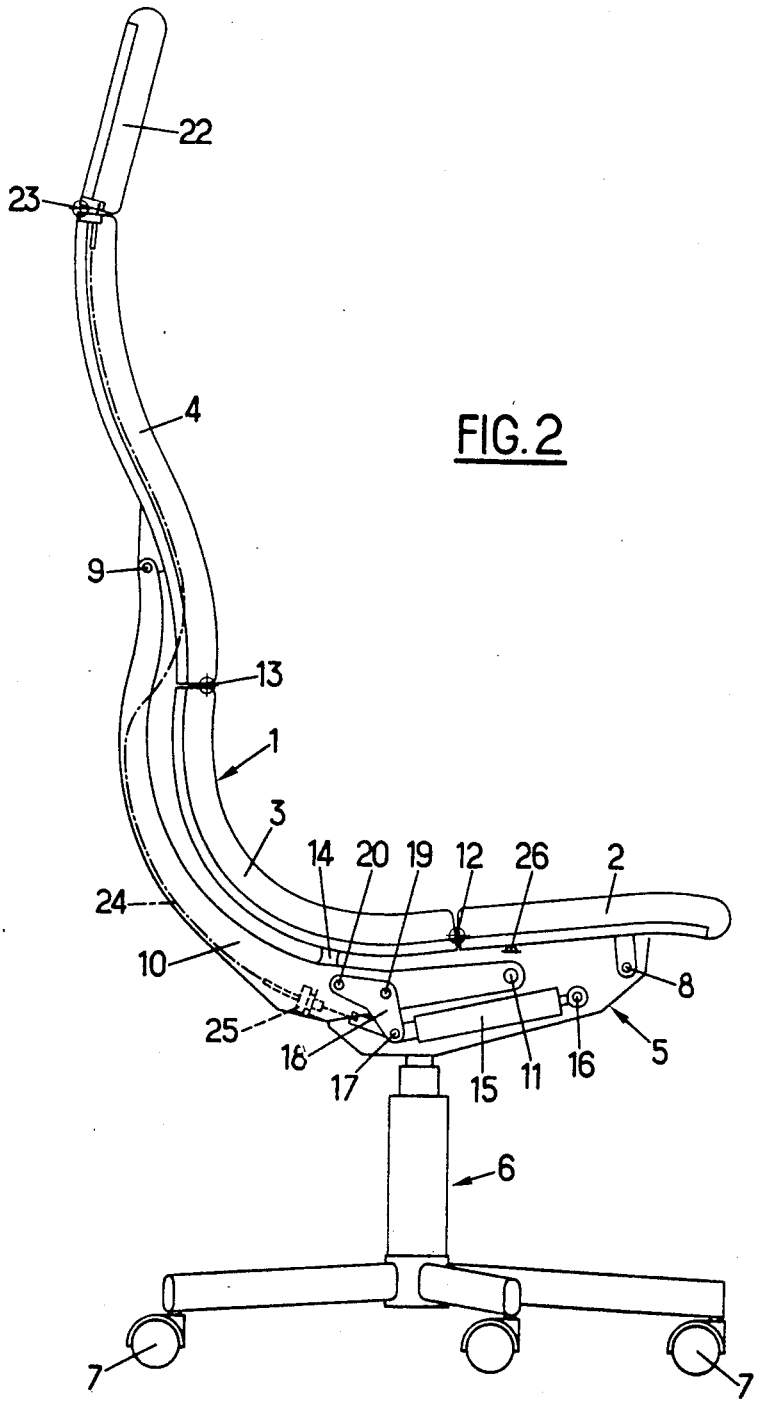
FIG. 2 is a view corresponding to that of FIG. 1, showing the same seat in the drawn-back position (position of rest or relxation)
Figure 3:
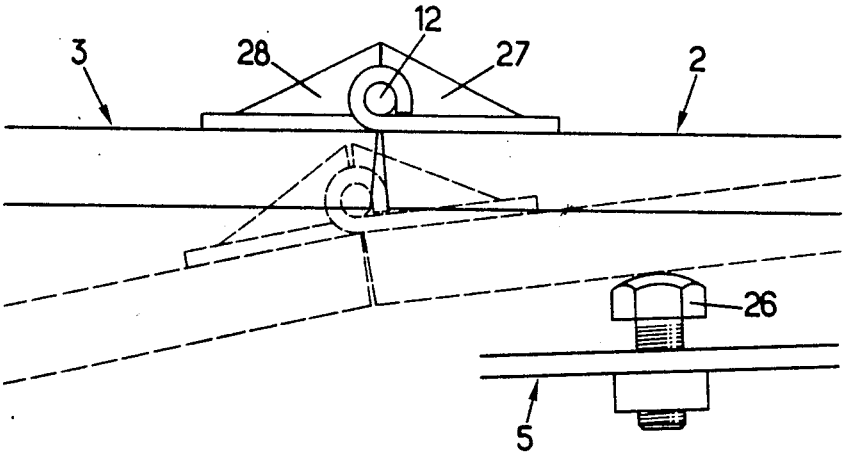
FIG. 3 shows, on a larger scale, the joint between the front part and rear part of the seating and the two stops limiting the travel of the seating parts.

As shown in FIG. 1 and in more detail in FIG. 3, the frame 5 carries an adjustable stop 26 for the front seating part 2. The stop 26, consisting of a screw engaged in a tapped hole in the frame 5 and locked in position by means of a lock nut, is arranged behind the pin 8, but in front of the pin 12. The stop 26 limits the downward and rearward angular travel of the front seating part 2 in the drawn-back position of the seat (FIG. 2).

It will also be seen from FIG. 3 that the joint between the two seating parts 2 and 3 (hinge pin 12) incorporates two stop pieces 27 and 28 on the said two parts 2 and 3, the two pieces 27 and 28 coming up against one another above the hinge pin 12 when the seat is in the forward position (FIG. 1) in order, in this position, to limit the downward travel of the two parts 2 and 3 about the pin 12 and give the two parts 2 and 3 a slight downward and forward tilt.

The body-supporting structure 1 thus forms an assembly of three articulated parts 2, 3, 4 which is suspended at two points 8 and 9 and maintained in position in the region of the middle part 3 by means of a flexible and deformable connection 14.

In the forward position (FIG. 1), the substantially flat front seating part 2 assumes a position slightly tilted forwards and downwards relative to the horizontal, so that this part 2 supporting the user's thighs does not impede the support of the user's feet on the ground and does not run the risk of cutting off the blood circulation above the knees.

During the shift from the forward position according to FIG. 1 to the drawn-back position according to FIG. 2, which, after the device 15 has been released, takes place under the rearward pressure exerted on the back 4 by the user, the bracket 10 pivots downwards about its hinge pin 11, thereby first causing the entire bodysupporting structure 1 to pivot downwards about the pin 8 and, after the front seating part 2 has come in contact with the stop 26, causing a transfer of the pivoting movement to the pin 9, that is to say causing the top of the back 4 to pivot towards the rear about the pin 9 and, at the same time, the rear seating part 3 to pivot upwards and forwards about the pin 12. The back 4 is articulated on the bracket and on the rear seating part 3 in such a way that the part of the back 4 located below the pin 9 follows such a path, during the change of position, that it supports the user's back effectively in all the positions of the seat. It is appropriate to note that the front seating part 2, in its position bearing on the stop 26, is slightly tilted rearwards and downwards, so as to prevent the body from slipping forwards in the drawn-back position of the seat.

The headrest 22 pivots in opposition to the back 4 on which it is articulated, that is to say it moves forwards when the latter moves backwards, and in the drawn-back position of the seat it adopts a position tilted more towards the front than in the forward position of the seat. The headrest is in fact used most in the drawn-back position of the seat, which corresponds to the position of relaxation or rest.

By adjusting the spring provided in the position-maintaining and return device 15, it is possible to adjust the balance between the two torques acting on the lever 18, on the one hand in accordance with the user's weight and on the other hand according to the return force of the device 15.

I claim:

1. Seat, especially work seat, comprising a frame mounted vertically adjustable on a support base and carrying a body-supporting structure including a substantially flat front seat portion, a curved rear seat portion and a back rest portion, a curved bracket having a lower front end and an upper rear end on the frame for supporting the back rest portion, the front seat portion having a front end and a rear end and being pivoted near its front end by a first horizontal transverse axis to the frame near the front end thereof and at its rear end by a second horizontal transverse axis to the front end of the rear seat portion, the bracket being pivoted at its lower front end by a third horizontal transverse axis to the frame, in front of said second axis, a positioning means provided having one portion attached to the bracket between the two ends of the bracket another portion attached to and the frame for maintaining the bracket in several positions with respect to the frame around the said third axis, the back rest portion having an upper end and a lower end and being pivoted between the said two ends by a fourth horizontal transverse axis to the upper rear end of the bracket and at its lower end by a fifth horizontal transverse axis to the rear upper end of the rear seat portion, and the rear seat portion being flexibly connected, between the said second and the fifth axes, by a non-rigid connection to the bracket so that the body supporting structure can be brought into a forward position in which the front end of the rear seat portion and the front seat portion are slightly inclined forwards and downwards relative to the horizontal, and into a draw-back position in which the front end of the rear seat portion and the front seat portion are inclined rearwards and downwards relative to the horizontal.

2. Seat according to claim 1, wherein stop means are provided between the front seat portion and the rear seat portion for limiting inclination of the front seat portion in the forward position with respect to the inclination of the front end of the rear seat portion.

3. Seat according to claim 1, wherein the said frame comprises stop means for limiting inclination of the front seat portion in a drawn-back position.

4. Seat according to claim 3, wherein said stop means is adjustable.

5. Seat according to claim 1, wherein said non-rigid connection comprises an elastic component.

6. Seat according to claim 1, wherein said positioning means comprises a position-maintaining and forward-position returning device, which acts on the said bracket by a two-arm lever pivoted by a horizontal transverse axis on the said frame.

7. Seat according to claim 6, wherein said device comprises a pneumatic jack, which can be locked in position and a spring in parallel with said jack.

8. Seat according to claim 7, wherein said spring is adjustable.

9. Seat according to claim 6, further comprising a headrest pivoted by a horizontal transverse axis on the upper end of the back rest portion and position-controlled by a flexible cable actuated by the position-maintaining and forward-position returning device.

* * * * *